US010106970B2

(12) United States Patent
Plank et al.

(10) Patent No.: US 10,106,970 B2
(45) Date of Patent: Oct. 23, 2018

(54) TILEABLE DRAIN SYSTEMS AND RELATED METHODS

(71) Applicant: Schluter Systems L.P., Plattsburgh, NY (US)

(72) Inventors: Reinhard H. Plank, Plattsburgh, NY (US); Sean P. Gerolimatos, Plattsburgh, NY (US)

(73) Assignee: Schluter Systems L.P., Plattsburgh, NY (US)

( * ) Notice: Subject to any disclaimer, the term of this patent is extended or adjusted under 35 U.S.C. 154(b) by 299 days.

(21) Appl. No.: 13/681,170

(22) Filed: Nov. 19, 2012

(65) Prior Publication Data

US 2013/0318705 A1 Dec. 5, 2013

Related U.S. Application Data

(60) Provisional application No. 61/561,650, filed on Nov. 18, 2011.

(51) Int. Cl.
*E03F 5/04* (2006.01)

(52) U.S. Cl.
CPC ..... *E03F 5/0408* (2013.01); *E03F 5/0407* (2013.01); *E03F 5/0409* (2013.01); *Y10T 29/49826* (2015.01)

(58) Field of Classification Search
USPC ..... 4/612, 613
See application file for complete search history.

(56) References Cited

U.S. PATENT DOCUMENTS

| | | | |
|---|---|---|---|
| D259,950 | S | 7/1981 | Henry |
| 5,140,789 | A | 8/1992 | DeGooyer |
| D355,707 | S | 2/1995 | Emannuele et al. |
| 5,458,769 | A | 10/1995 | Johannessen |
| 5,845,347 | A | 12/1998 | Young |
| 6,155,015 | A | 12/2000 | Kirby |

(Continued)

FOREIGN PATENT DOCUMENTS

| | | | |
|---|---|---|---|
| EP | 2333173 | 6/2011 | |
| EP | 2664722 A2 * | 3/2015 | ..... E03F 5/04 |

(Continued)

OTHER PUBLICATIONS

U.S. Appl. No. 13/681,156, filed Nov. 19, 2012; Reinhard H. Plank.

(Continued)

*Primary Examiner* — Erin Deery
(74) *Attorney, Agent, or Firm* — Thorpe North & Western, LLP

(57) ABSTRACT

A tile installation comprises a plurality of surface tiles installed upon a surface, the plurality of surface tiles defining a perimeter area that at least partially circumscribes a drain area. A drain fitting is installed within the drain area. A frame is in fluid communication with the drain fitting, the frame including: i) an at least partially horizontal support surface; and ii) installation block receiving structure, with which an installation block can be mated. A drain tile support is removably fittable within the frame, the drain tile support including an upper surface to which a drain tile can be attached, and at least one support feature extending away from the upper surface and restable upon the support surface of the frame.

19 Claims, 7 Drawing Sheets

(56) References Cited

U.S. PATENT DOCUMENTS

| | | | | |
|---|---|---|---|---|
| D519,618 | S | 4/2006 | Audette et al. | |
| D582,527 | S | 12/2008 | Wang | |
| D596,721 | S | 7/2009 | Hisey | |
| D596,722 | S | 7/2009 | Hisey | |
| 7,739,757 | B2 * | 6/2010 | Witt | 4/613 |
| 7,752,686 | B2 | 7/2010 | Polimeno | |
| 8,918,926 | B1 | 12/2014 | Herring | |
| 9,107,545 | B1 * | 8/2015 | Herring | |
| 2004/0205890 | A1 | 10/2004 | Smale | |
| 2006/0213006 | A1 | 9/2006 | Rush, Jr. et al. | |
| 2007/0056088 | A1 * | 3/2007 | DeGooyer | 4/613 |
| 2008/0016614 | A1 | 1/2008 | Daniels | |
| 2008/0163419 | A1 | 7/2008 | Nishi | |
| 2008/0229494 | A1 * | 9/2008 | DeGooyer | E03C 1/20 4/613 |
| 2008/0277324 | A1 | 11/2008 | Meyers | |
| 2009/0320204 | A1 | 12/2009 | Wiseman et al. | |
| 2010/0000169 | A1 | 1/2010 | Grave et al. | |
| 2010/0064430 | A1 | 3/2010 | Goodson | |
| 2010/0154112 | A1 | 6/2010 | Goodhue | |
| 2010/0170035 | A1 | 7/2010 | Kik, Sr. et al. | |
| 2010/0288685 | A1 | 11/2010 | Meyers | |
| 2011/0197355 | A1 | 8/2011 | Lemire | |
| 2011/0203979 | A1 | 8/2011 | Schlueter | |
| 2012/0036630 | A1 * | 2/2012 | Cook | 4/679 |

FOREIGN PATENT DOCUMENTS

| | | | | |
|---|---|---|---|---|
| JP | 2000265513 A * | 9/2000 | | E03C 1/12 |
| WO | WO 2010/083568 | 7/2010 | | |

OTHER PUBLICATIONS

Lux Elements®—TUB-BA . . . —Floor drain systems (horizontal, DN 50); http:www.luxelements.com/luxen/program/tub/ohne/ablaufstutzen-Waagerect; accessed Aug. 2, 201; 4 pages.

ACO, "Quartz by ACO Tile Grate", http://www.quartzbyaco.com/sites/default/file/Tile_grate.pdf, Aug. 2010, pp. 1, ACO Polymer Products Inc, Casa Grande, Arizona.

I-Drain, "I-Drain Installation Instructions", https://web.archive.org/web/20101122135445/http:/www.i-drain.net/pdf/IDRAIN_Installation_Instructions.pdf, Nov. 22, 2010, pp. 8.

Office Action for U.S. Appl. No. 13/681,156 dated Jun. 4, 2015, 27 pages.

* cited by examiner

TILEABLE DRAIN SYSTEMS AND RELATED METHODS

PRIORITY CLAIM

This application claims priority of U.S. Provisional Patent Application Ser. No. 61/561,650, filed Nov. 18, 2011, which is hereby incorporated herein by reference in its entirety.

RELATED CASES

This application is related to U.S. patent application Ser. No. 13/681,156 , filed Nov. 19, 2012, titled Tileable Line Drain Systems and Related Methods.

BACKGROUND OF THE INVENTION

Field of the Invention

The present invention relates generally to the field of drainage systems for use in flooring installations. More particularly, the present systems are well suited for use in drainage systems incorporated into shower installations and related structures.

Related Art

Drainage outlets installed in applications such as showers typically include a perforated grate that allows water to flow into a drain housing while preventing large objects from entering the drain housing. Most quality drain assemblies include a frame of one sort or another into which the perforated grate is removably installed. The grate is removable to allow cleaning of the drain housing, replacement of the grate with a newer or different grate, etc. Typically, the frame limits the tile covering at the drain area and allows grouting of the tile surface adjacent to the frame. Without the frame, the grate might be grouted in place during tile installation, which would make it difficult to remove the grate for cleaning.

While this conventional grate configuration has been used for many years with some degree of success, there are drawbacks to this system. For example, many consumers and designers do not like the appearance of most perforated grates (or the appearance of any perforated grate). Even in cases where it is possible to offer a wide range of grate options, such as varied colors, finishes, etc., many consumers and designers are not satisfied with the available options.

SUMMARY OF THE INVENTION

In accordance with one aspect of the invention, a tile installation is provided, including a plurality of surface tiles installed upon a surface, the plurality of surface tiles defining a perimeter area that at least partially circumscribes a drain area. A drain fitting can be installed within the drain area. A frame can be in fluid communication with the drain fitting, the frame including: i) an at least partially horizontal support surface; and ii) installation block receiving structure, with which an installation block can be mated. A drain tile support can be removably fittable within the frame, the drain tile support including an upper surface to which a drain tile can be attached, and at least one support feature extending away from the upper surface and restable upon the support surface of the frame.

In accordance with another embodiment, a method of providing drainage for a tile installation without the use of a visible drain grate is provided, including: coupling a frame within a drain area of a tile installation, the frame including i) an at least partially horizontal support surface; and ii) installation block receiving structure, with which an installation block can be mated; installing a plurality of surface tiles upon a surface adjacent the frame, the plurality of surface tiles defining a perimeter area that at least partially circumscribes the drain area, at least a portion of some of the surface tiles abutting a plane extending upwardly from a portion of the installation block receiving structure; and fitting a drain tile support within the frame, the drain tile support including an upper surface to which a drain tile can be coupled, and at least one support feature extending away from the upper surface and restable upon the support surface of the frame; wherein the drain tile is sized so as to define an opening between edges of the drain tile and adjacent surface tiles to allow drainage of liquid through the opening and into the drain fitting.

In accordance with another aspect of the invention, a tileable drain assembly is provided, including a frame, in fluid communication with a drain fitting installed within a drain area, the frame including: i) an at least partially horizontal support surface; and ii) installation block receiving structure with which an installation block can be removably mated; and a drain tile support, removably mateable with the frame, the drain tile support including an upper surface to which a drain tile can be attached, and at least one support feature extending away from the upper surface and restable upon the support surface of the frame.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
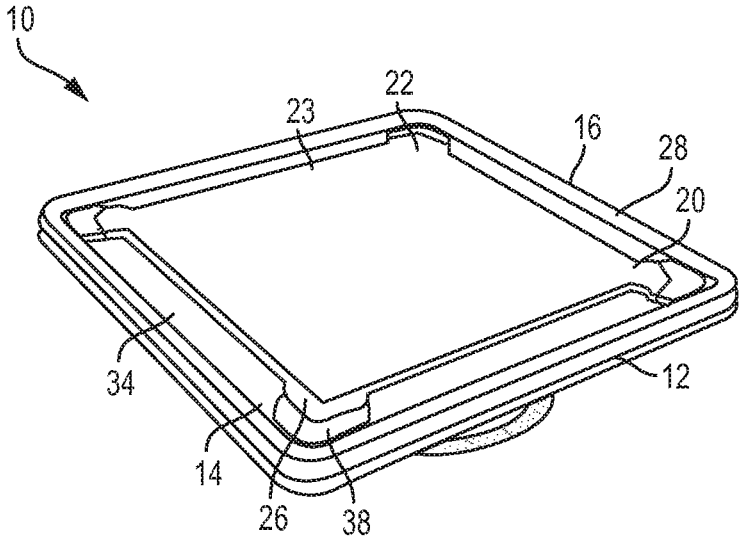
FIG. 1 is a perspective view of a drain frame having a drain tile support fitted therein.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a support structure" can include one or more of such structures.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms are sometimes used herein to describe and claim various components of the drain systems of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art. For example, the term "horizontal" is sometimes used to refer to various portions or elements of drain frames: as one of ordinary skill in the art would readily appreciate, this usage is not intended to be limited to a component that is absolutely horizontal, but can be extended to components that are primarily horizontal, or mostly horizontal. A horizontal component, as that term is used herein, can include a slight slope that enables drainage of liquids across the slope.

As used herein, the term "tile" is to be understood to refer to a generally planar slab-like component that can be used as a floor or wall covering. Tiles discussed herein can be formed of a variety of materials, including without limitation, ceramic, marble, stone, granite, polymers, glass, and the like.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present invention relates generally to improved drain systems that provide functional drainage for shower systems and similar installations while presenting a very discrete drain appearance. Systems in accordance with the present invention can appear, to the casual observer, as a series of tiles uninterrupted by any drain grate or similar feature. Instead of a drain grate, the present systems utilize a drain tile around which liquid can exit a drain area into a drain assembly below. The drain tile can be selected so as to be identical in appearance to surrounding tiles, or it can be selected as a decorative tile, which differs in material or appearance (or both) from surrounding surface tiles.

Figure 2:
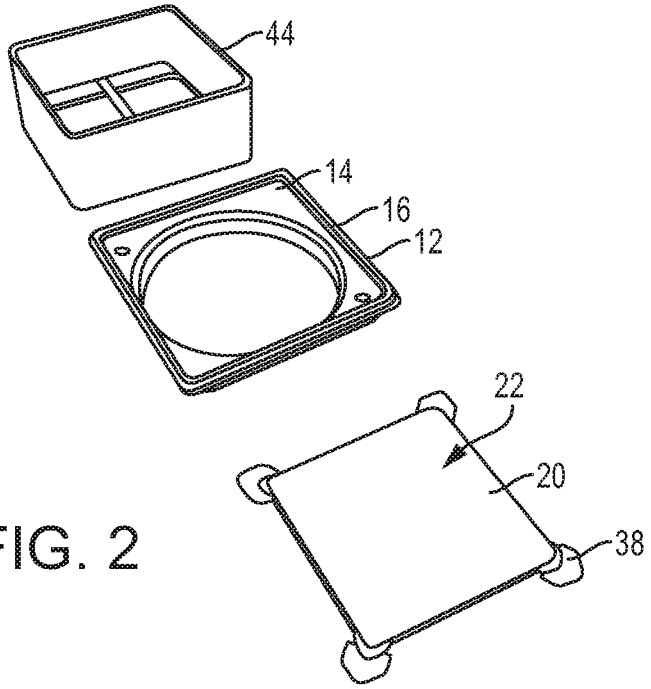
FIG. 2 is a perspective view of the drain frame and drain tile support of FIG. 1, shown separated from one another, with an installation block also shown.

One exemplary embodiment of the invention is illustrated in FIGS. 1-5. With particular reference to FIGS. 1 and 2, in this example the system 10 can include a frame 12, which can be coupleable to a drain fitting (13 or 13' in FIG. 4) installed within a drain area. The frame can include an at least partially horizontal support surface 14 (also shown in FIGS. 2 and 4). Installation block receiving structure (in this case, frame wall 16 that includes an interior face 18 (best seen in side view in FIG. 4)), can also be provided to receive an installation block 44 (discussed in more detail below). A drain tile support 20 can be removably fittable within the frame. The drain tile support can include an upper surface 22 to which a drain tile 24 can be attached. At least one support feature, in this case leg 26, can be formed below, or can extend downwardly from, the upper surface 22 and can thus be restable upon the support surface 14 of the frame. Typically, the upper surface 22 of the drain tile support 20 is elevated at least as high as an upper surface (28 in FIG. 1) of the frame wall when the drain tile support is fitted within the frame.

Figure 4:
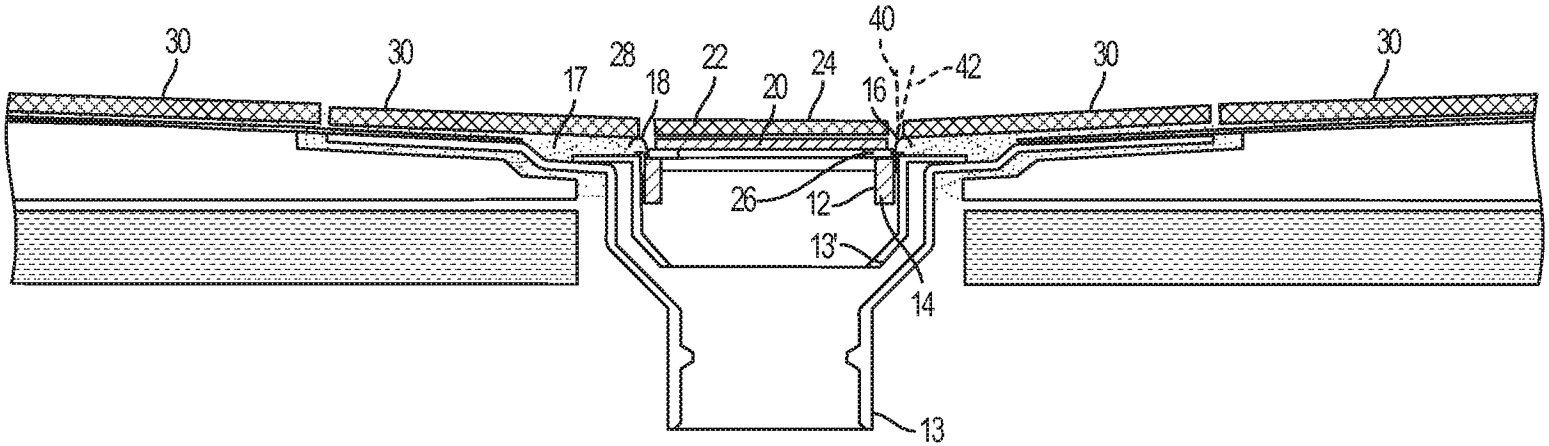
FIG. 4 is a side, partially sectioned, schematic view of a tile installation in accordance with an embodiment of the invention (note that some components are shown generically and may not correspond to actual physical dimensions)
Figure 5:
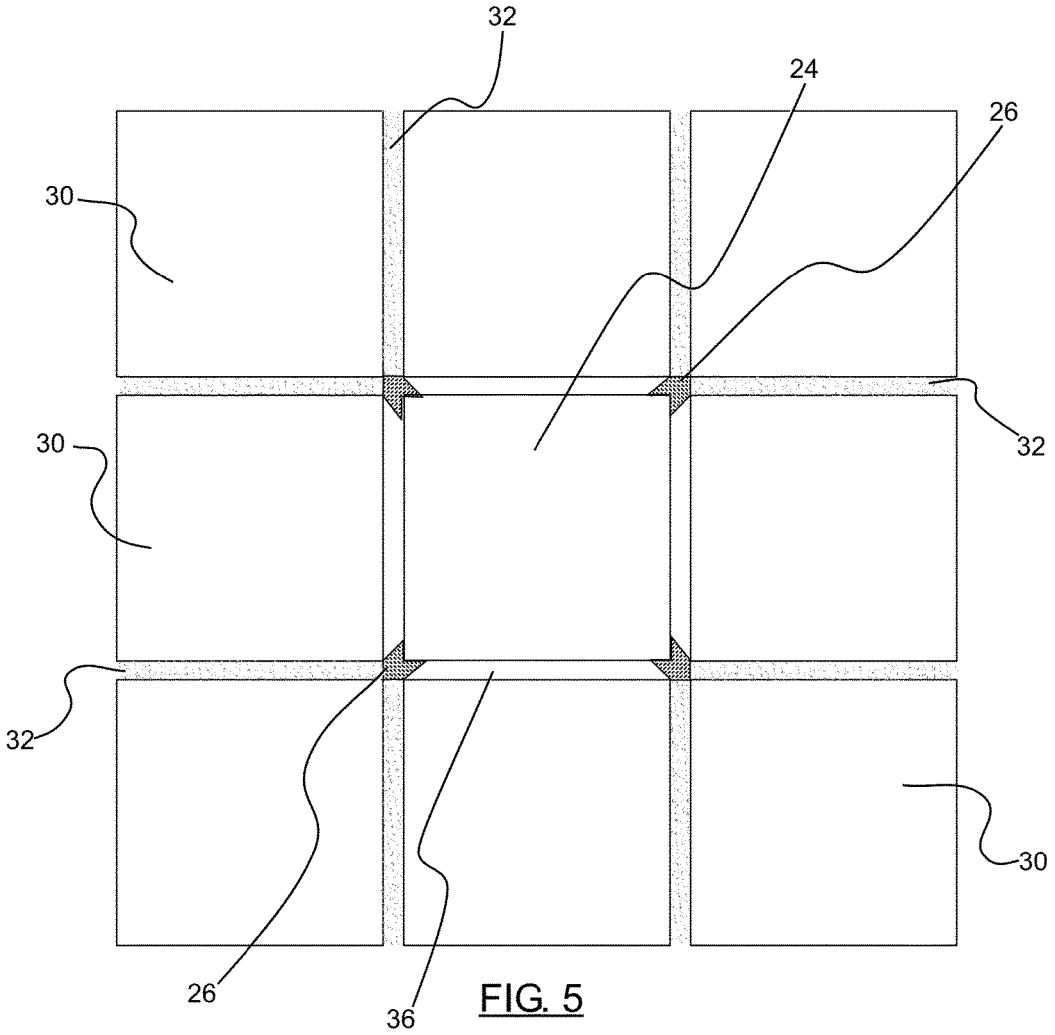
FIG. 5 is a top view of the tile installation of FIG. 4.

As shown best in FIG. 4, in use, the frame 12 is typically coupled to the drain fitting 13 or 13' (which is configured to allow drainage of liquid from the shower installation to a suitable waste water drain pipe, not shown). A drain tile 24 can be attached to the drain tile support 20 in a variety of manners, depending upon the type of drain tile selected, and the material of the drain tile support. Once the drain tile is coupled to the drain tile support, the drain tile support can be removably fitted within the frame, as shown in FIGS. 4 and 5. In this manner, a drainage system is provided for the tile installation that provides adequate drainage for the tile installation without the use of a standard perforated grate.

The resulting installation is perhaps best appreciated from FIGS. 4 and 5, where drain tile 24 is shown surrounded by adjacent surface tiles 30. While the area between the several adjacent surface tiles is shown filled with grout 32, it will be appreciated that the area (or gap, or opening 36) between edges of the drain tile 24 and the adjacent tiles 30 is not filled with grout (or any other material). Thus, the gap or opening 36 allows for the drainage of liquid beyond the drain tile and to the drainage system below. The appearance of the installation is very clean and neat, without the unsightly presence of a perforated grate.

As will be appreciated from FIG. 5, the only structure supporting the drain tile 24 that is visible to the human eye are the support legs 26. However, because the legs are positioned at an elevation that is at least a thickness of the drain tile beneath the surface of the tile installation, they are only visible by closely inspecting the installation from directly above the drain tile. When viewed from afar, or at an angle, there is no visible structure supporting the drain tile: the drain tile appears exactly like the adjacent surface tiles, save for the absence of grout surrounding the drain tile.

While some prior art systems have attempted to minimize the visual impact of frames that hold grates or tiles, in these system there is still some part of the underlying frame or support structure plainly visible when viewing the installation. For example, attempts have been made to provide a frame that is very thin, so as to minimize the visual impact of the frame. However, this thin frame is still visible to the casual observer. In contrast, the present invention advantageously hides all supporting structure from casual view. There is no unsightly frame visible, of any thickness.

In the example shown in FIG. 5, the drain tile 24 is substantially circumscribed by the adjacent tiles 30. One of ordinary skill in the art will appreciate that all of the adjacent tiles 30 shown are sloped toward the drain tile 24 (and thus the gap or opening 36), to allow drainage into the gap or opening. Thus, this embodiment of the invention allows drainage to occur around all edges of the drain tile. In this manner, the present system can readily be incorporated into a variety of very common tiling designs, and need not, for example, be moved away from the center of the installation to allow water to flow in one direction across the entire installation.

While not so required, in one aspect of the invention, the upper surface 22 of the drain tile support can include a bondable interface 23 (FIGS. 1-3) attached thereto. The bondable interface can be in the form of a fleece membrane or the like which provides an improved bonding interface between the drain tile 24 and the upper surface 22 of the drain tile support. The bondable interface can be particularly useful when the material of the drain tile support 20 does not lend itself well to attachment of the drain tile. By attaching the bondable interface to the drain tile support (with an adhesive or other attachment means best suited for the two materials), the tile installer can use the same material (e.g., mortar) used in setting the adjacent surface tiles 30 to attach the drain tile 24 to the bondable interface (and thus to the drain tile support).

The present system not only provides a drainage system with the same functionality of conventional perforated grate systems (with the advantage of not requiring a perforated grate), it allows the use of a drain tile 24 of nearly any type desired by the designer or consumer. The drain tile can be selected to be identical to the adjacent surface tiles 30, or it can be formed of the same material as the adjacent tiles, but of a different color or appearance. Alternately, the drain tile can be formed of a completely different material: for example, the drain tile can be formed from glass, polymer, slate, granite, etc., while the adjacent surface tiles can be common ceramic tiles. Varying the composition and/or appearance of the drain tile relative to the adjacent tiles in no way affects the functionality of the present system.

In one aspect of the invention, the drain tile can be substantially the same size and shape as the generally planar portion of the drain tile support 20, so as to substantially completely cover this planar portion. In this aspect, the generally planar portion of the drain tile support can serve as a sizing template, to enable a tile installer to correctly size the drain tile to allow for the proper gap or opening size (36 in FIG. 5) to be created between the drain tile and adjacent surface tiles. In other embodiments, the drain tile can be larger than the planar portion, and so overhang the edges of the planar portion. In either case, the drain tile will generally completely conceal the planar portion of the drain tile support while also allowing a proper gap or opening to be formed between adjacent surface tiles.

As best seen in FIG. 1, the design of the drain tile support allows for the drainage of liquid beneath the drain tile (not shown in this figure). The one or more support legs 26 cause the generally planar portion of the drain tile support to be elevated above the point where the support legs contact any underlying support surface. In this manner, an opening or gap (34 in FIG. 1) is provided that allows drainage of liquid beneath the generally planar portion of the drain tile support. The support legs 26 shown in FIG. 1 are formed from the same material as the generally planar portion (in this case, a metallic material), and taper or curve downwardly to provide the elevation to the planar portion. It is to be understood, however, that a variety of differing configurations can be utilized. For example, one or more flat plates or links can be attached beneath the generally planar portion, and can extend beyond the edges thereof, to provide the elevation feature.

The exact degree of elevation provided by the support legs 26 can be varied to a particular application. For example, several different "heights" of drain tile supports 20 can be provided with an installation kit, to allow the installer to more precisely align the upper surface of the drain tile with adjacent surface tiles (see, e.g., FIG. 4, where the upper surface of drain tile 24 is substantially level with the upper surfaces of adjacent surface tiles 30). Alternately, a tile installer can attach spacer materials beneath the drain tile to raise its elevation, or, where the drain tile is too thick, can grind or otherwise reduce the thickness of the drain tile to allow for proper elevation adjustment of the drain tile.

In one aspect of the invention, an inner contour of the interior face (18 in FIG. 4) of the frame 12 matches an outer contour of the at least one support leg 26. For example, as shown in FIG. 1, the inner contour of the interior face of the frame is square: the interior face extends around the inside portion of the frame and includes four inside corners. The support legs terminate in generally triangular sections, which match the interior corners of the square. In this manner, a friction fit can be established between the support legs and the interior face of the frame. The friction fit can aid in retaining the drain tile support (and thus, the drain tile), in position during normal use of the shower installation. However, because the drain tile support is held in place only via this friction fit (and by gravity), it can easily be removed for cleaning or replacement purposes without the use of any tools. By contrast, removal of conventional perforated grates typically requires the use of a screwdriver or similar tool (a procedure that often involves dirty or worn fasteners that add complexity to the removal process).

In one aspect of the invention, the at least one support leg 26 can include a pliant material (38 in FIGS. 1, 2 and 3) attached thereto. In the example shown, the pliant material is in the form of an end cap that fits about the triangularly shaped feet of the support legs. The pliant material can provide a pliable interface between the support feature or leg and the frame, to both reduce any noise that may be associated with movement of the feet relative to the frame, and to enhance the friction fit between the feet and the interior face of the frame. The pliable material can be formed from a variety of materials, including without limitation, rubber, plastic and the like.

While the frame 12, 12*a* shown in the figures is generally square in shape, it is to be understood that a variety of shapes can be provided. For example, a round or oval frame can be provided, an elongated rectangular frame, or a variety of polygonal shapes can be provided. In this manner, the system can be tailored to provide the most aesthetically pleasing appearance for any particular installation.

As best appreciated from FIGS. 4 and 5, in one aspect of the invention, a tile installation utilizing the frame 12 and drain tile support 20 can be provided. In this example, at least a portion of some of the surface tiles 30 can extend over the frame wall 16 to abut, or slightly overhang, a plane (shown by example at 40, 42 in FIG. 4) extending upwardly from the interior face of the frame wall. In this manner, the frame wall generally serves as a barrier (either physically or optically) to prevent mortar, grout, adhesive etc., from entering the drain area. This is important for at least the reason that a consistent gap or opening need be maintained between the drain tile 20 and adjacent surface tiles to allow drainage through the gap or opening.

Figure 3:
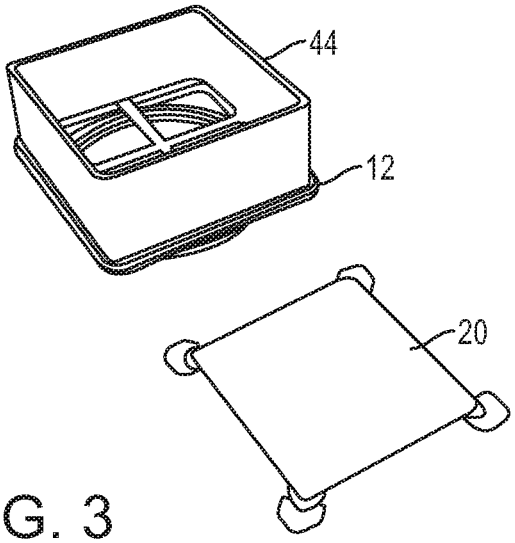
FIG. 3 is a perspective view of the drain frame and installation block of FIG. 2, with the installation block fitted within the drain frame.

In one example, an installation aid is provided with the present system to aid the tile installer in maintaining the adjacent surfaces tiles 30 (along with any mortar, grout, etc.) from overhanging the interior face of the frame wall. As shown in FIG. 3 (and shown separated in FIG. 2), in one aspect of the invention, an installation block 44 can be provided that can be removably fittable within the interior of the frame wall. The installation block provides a template that allows adjacent surface tiles to be installed while precisely aligned with a plane extending upwardly from the interior face of the frame wall. Two exemplary planes are illustrated in FIG. 4 at 40 and 42. Plane 40 extends generally vertically upward and corresponds to an interior face of the frame wall having a vertical orientation. While it is likely that the interior face of the frame wall will be substantially vertical, it can be slightly angled (as shown by example at 42).

The installation block 44 provides a simple and easily used aid for maintaining the adjacent surfaces tiles 30 a proper distance from the drain tile. In use, a tile installer can first install the frame 12 in position in the drainage system. The installation block can then be inserted into the frame and fitted snugly against the interior face of the frame wall 16. The tile installer can then install the adjacent surface tiles around, and abutting against, the installation block. The tile installation can then be grouted. After the installation has cured to an appropriate point, the installation block can be removed, leaving behind a perfectly shaped opening. After removal of the installation block, the drain tile support can be installed within the frame, thereby positioning the drain tile and forming a drainage opening or gap 36 between edges of the drain tile and the adjacent surface tiles.

Turning now to FIGS. 6A through 8B, another embodiment of the invention is illustrated in which frame 12*a* is provided. In this aspect, frame 12*a* can be formed in a generally flat configuration and can sit atop a drain fitting (e.g., within depression 17 of FIG. 4) to provide much the same function as the embodiment described above. In this case, however, it is not necessary to install any portion of the frame 12*a* into the drain passage or throat. The frame can sit atop a portion of the drain fitting (13, for example), and can be laterally adjusted (e.g., slid one direction or another) before being bonded into place to ensure proper alignment with the drain fitting.

Figure 8A:
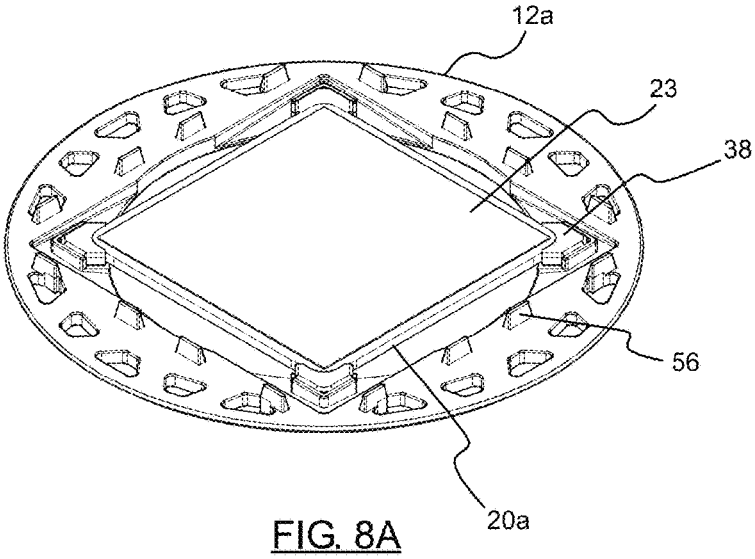
FIG. 8A is a perspective view of the frame of FIG. 6A with the drain tile support of FIG. 7A installed therein.
Figure 8B:
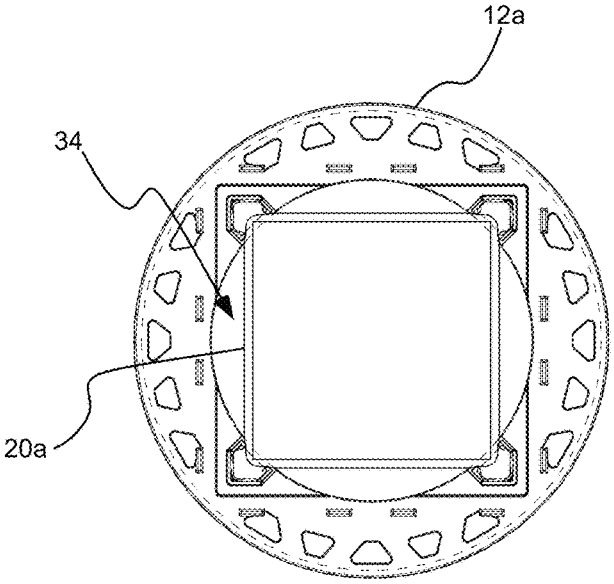
FIG. 8B is a top view of the frame and drain tile support assembly of FIG. 8A.

Frame 12*a* can include many features that are functionally similar to the embodiment discussed above. For example, drain tile support 20*a*, shown in FIGS. 7A, 7B, 8A and 8B, can be fitted to the frame 12*a* via support feature retention notches (54 in FIG. 6C). When so fitted to or within the frame, the drain tile support 20*a* can provide a manner in which a drain tile can be installed over a drain fitting to provide a drain system with no visible grate structure. As shown in FIG. 8B, the design of the present frame and drain tile support can provide openings 34 through which liquids can drain to the underlying drainage system (note that some of the openings 34 will be obscured after drain tile is attached to the drain tile support 20*a*).

The drain tile support can include one or more support features (26*a* in FIG. 7A) that provide support to the drain tile support to maintain the drain tile support in position. In the example shown in FIGS. 7A and 7B, the support features comprise legs or feet that extend away from an upper surface 22*a* of the drain tile support. In this aspect, the drain tile support is substantially flat, and thus the legs or feet shown do not provide additional elevation to the drain tile carried by the support. When fitted within the retention notches (54 in FIG. 6C), the drain tile support is held in place both vertically and laterally. While the retention notches are shown comprising corner features, it is to be understood that the retention notches can be formed in a variety of geometries and positions relative to the drain tile support and the frame.

Figure 6A:
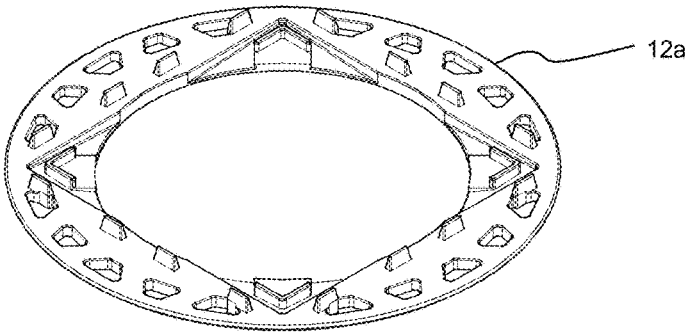
FIG. 6A is a perspective view of a drain frame in accordance with another embodiment of the invention.
Figure 6B:
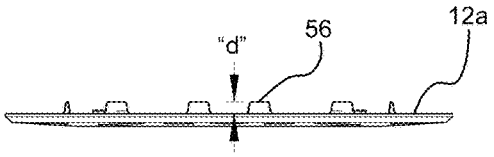
FIG. 6B is a side view of the frame of FIG. 6A.
Figure 6C:
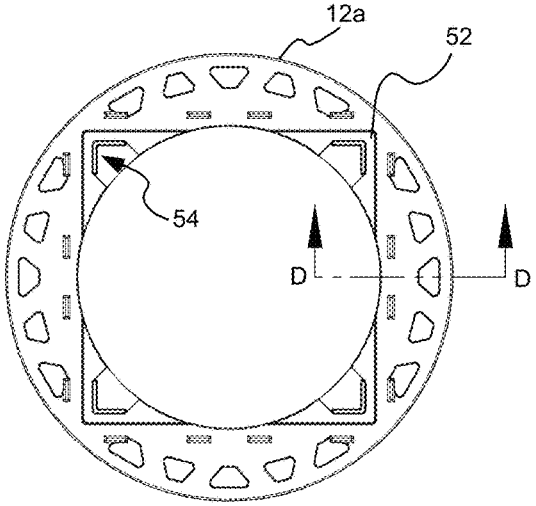
FIG. 6C is a top view of the frame of FIG. 6A.
Figure 6D:
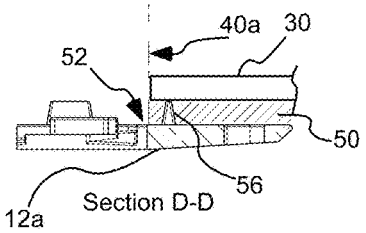
FIG. 6D is a sectional view of the frame of FIG. 6A, taken along section D-D of FIG. 6C.
Figure 7A:
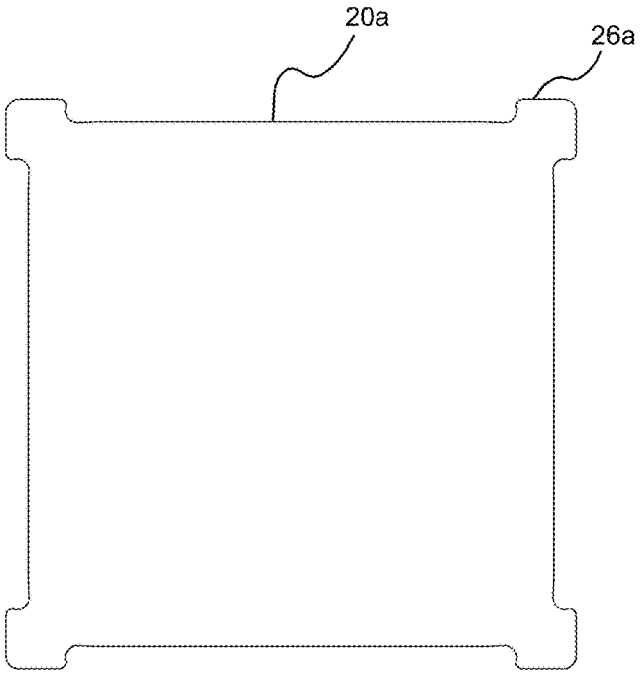
FIG. 7A is a top view of a drain tile support in accordance with another embodiment of the invention.
Figure 7B:
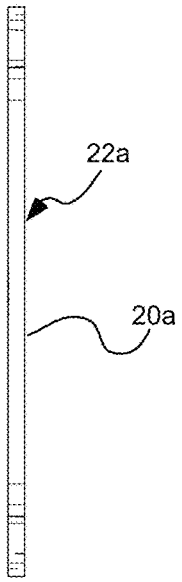
FIG. 7B is a side view of the drain tile support of FIG. 7A.

As shown at 56 in FIGS. 6B and 6D, the frame 12*a* can include one or more vertical spacers 56 attached thereto or formed therewith. The vertical spacers can serve to provide a template or guide to an installer to ensure that adjacent tiles 30 are installed to a height that corresponds with a height (distance "d" in FIG. 6B) that the drain tile (e.g., 24 in FIG. 4) will be held at. This relationship is shown by example in FIG. 6D, where adjacent tile 30 is coupled, via thin set or mortar 50, over the frame 12*a*. The spacer 56 ensures that all of the adjacent tiles are installed to the proper height, and, by design of the frame and the drain tile support, that the drain tile is maintained at the same height as the adjacent tiles.

FIG. 6D also illustrates another feature of the frame 12*a*, that is installation block receiving structure 52. This feature functions similarly to the frame wall 16 discussed in relation to the embodiment above (see, e.g., FIGS. 2 and 3). An installation block 44 (not shown in FIGS. 6A through 8B) can be fitted within the installation block receiving structure 52 and thus held in position while the adjacent tiles 30 are installed. In the aspect illustrated in FIG. 6D, the installation block receiving structure 52 includes a groove formed in the frame 12*a*. The groove can substantially match a contour of the installation block, such that the installation block can be snugly pressed into the groove and held in position.

While the installation block is held in position, adjacent tiles 30 can be positioned abutting the installation block (and thereby aligned with plane 40*a* of FIG. 6D) and bonded into position with mortar or thin set 50. Once the adjacent tiles are bonded into position, and, if desired, grouted, then the installation block can be removed to allow installation of the drain tile support 20*a* (see, e.g., FIGS. 8A and 8B, which show the drain tile support installed within the frame 12*a*).

As in other embodiments, the drain tile support 12*a* can include a bondable interface 23 attached thereto, which can provide a more secure interface between the drain tile and the support. Also, while not shown explicitly in the figures, a bondable interface can be provided beneath the frame 12*a* to allow a more secure bond of the frame to underlying structure. In addition to the structural elements discussed above, the present invention can also provide a method of providing drainage for a tile installation without the use of a visible drain grate. The method can include coupling a frame to a drain fitting within a drain area of a tile installation, the frame including i) an at least partially horizontal support surface; and ii) a frame wall having an interior face. A plurality of surface tiles can be installed upon a surface adjacent the frame, the plurality of surface tiles defining a perimeter area that at least partially circumscribes the drain area, at least a portion of some of the surface tiles extending over the frame wall to abut or overhang a plane extending upwardly from the interior face of the frame wall. A drain tile support can be fitted within the frame, the drain tile support including an upper surface to which a drain tile is coupled, and at least one support leg extending downwardly from the upper surface and restable upon the support surface of the frame. Generally, the drain tile is sized so as to define an opening between edges of the drain tile and adjacent surface tiles to allow drainage of liquid through the opening and into the drain fitting.

The method can include temporarily fitting an installation block into an opening defined by the interior face of the frame wall, and abutting the surface tiles against the installation block while installing the surface tiles upon the surface adjacent the frame. The installation block can extend upwardly substantially coplanar with a plane defined by the interior surface of the frame wall.

A method of providing drainage for a tile installation without the use of a visible drain grate can also be provided, including: coupling a frame within a drain area of a tile installation, the frame including i) an at least partially horizontal support surface; and ii) installation block receiving structure, with which an installation block can be mated; installing a plurality of surface tiles upon a surface adjacent the frame, the plurality of surface tiles defining a perimeter area that at least partially circumscribes the drain area, at least a portion of some of the surface tiles abutting a plane extending upwardly from a portion of the installation block receiving structure; and fitting a drain tile support within the frame, the drain tile support including an upper surface to which a drain tile can be coupled, and at least one support feature extending away from the upper surface and restable upon the support surface of the frame.

The drain tile can be sized so as to define an opening between edges of the drain tile and adjacent surface tiles to allow drainage of liquid through the opening and into the drain fitting.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

What is claimed is:

1. A tile installation, comprising:

a plurality of surface tiles installed upon a surface, the plurality of surface tiles defining a perimeter area that at least partially circumscribes a drain area;

a drain fitting, installed within the drain area;

a frame, in fluid communication with the drain fitting and being laterally adjustable relative to the drain fitting when seated on the drain fitting, the frame including: i) an at least partially horizontal support surface; ii) an installation block receiving structure, with which an installation block can be mated; and iii) a plurality of vertical spacers extending upwardly from the frame, the plurality of vertical spacers providing a template for vertically spacing surface tiles relative to the frame;

an adhesive extending beneath one or more surface tiles and above the at least partially horizontal support surface of the frame, the adhesive coupling the one or more surface tiles to the at least partially horizontal support surface of the frame, each of the one or more surface tiles resting upon one or more of the plurality of vertical spacers; and a drain tile support, removably fittable within the frame, the drain tile support including an upper surface, the upper surface operable to receive and support a drain tile, and at least one support feature extending away from the upper surface and restable upon the at least partially horizontal support surface of the frame.

2. The tile installation of claim 1, wherein at least a portion of some of the surface tiles abut a plane extending upwardly from a portion of the installation block receiving structure.

3. The tile installation of claim 1, wherein all structure of the frame and the drain tile support is positioned at least the distance of a tile thickness away from an upper surface of the tile installation, so as to be substantially hidden from view when a drain tile is supported by the upper surface of the drain tile support.

4. The tile installation of claim 1, further comprising an opening defined between the upper surface of drain tile support and the drain fitting, the opening providing an area for drainage of liquid into the drain fitting.

5. The tile installation of claim 1, further comprising a drain tile attached to the upper surface of the drain tile support, and wherein an opening is defined between edges of the drain tile and surface tiles adjacent to the drain tile to allow drainage of liquid through the opening and into the drain fitting.

6. The tile installation of claim 5, wherein the upper surface of the drain tile support is substantially covered by the drain tile.

7. The tile installation of claim 5, wherein a measureable, vertical distance is defined between a bottom of the support feature and a top of the upper surface of the drain tile support, so as to elevate an upper surface of the drain tile substantially level with an upper surface of the surface tiles adjacent to the drain tile.

8. The tile installation of claim 5, wherein the drain tile is substantially centered within, and circumscribed by, the plurality of surface tiles.

9. The tile installation of claim 1, wherein the upper surface of the drain tile support includes a bondable interface attached thereto.

10. The tile installation of claim 1, wherein the at least one support feature includes a pliant material attached thereto, the pliant material providing a pliable interface between the support feature and the at least partially horizontal support surface of the frame.

11. The tile installation of claim 10, wherein the pliant material substantially encases a foot of the at least one support feature and provides a pliable interface between the foot of the support feature and a support feature receiving notch formed in the frame.

12. The assembly of claim 1 wherein the one or more of the plurality of vertical spacers are encompassed by the adhesive extending between the one or more surface tiles and the frame.

13. A tileable drain assembly, comprising:

a frame seated on and laterally adjustable relative to a drain fitting installed within a drain area, the frame including: i) an at least partially horizontal support surface; ii) installation block receiving structure with which an installation block can be removably mated; and iii) a plurality of vertical spacers extending upwardly from the frame, an adhesive extending beneath one or more surface tiles and above the at least partially horizontal support surface of the frame, the adhesive coupling the one or more surface tiles to the at least partially horizontal support surface of the frame, each of the one or more surface tiles resting upon one or more of the plurality of vertical spacers; and a drain tile support, removably mateable with the frame, the drain tile support including an upper surface, the upper surface operable to receive and support a drain tile, and at least one support feature extending away from the upper surface and restable upon the at least partially horizontal support surface of the frame.

14. The assembly of claim 13, further comprising an opening defined between the support feature and the drain fitting, the opening providing an area for drainage of liquid into the drain fitting.

15. The assembly of claim 13, wherein the upper surface of the drain tile support includes a bondable interface attached thereto.

16. The assembly of claim 13, wherein the at least one support feature includes a pliant material attached thereto, the pliant material providing a pliable interface between the support feature and the frame.

17. The assembly of claim 13, further comprising an installation block, removably fittable within the installation block receiving structure, the installation block providing a template that allows adjacent surface tiles to be installed while creating an opening between the adjacent tiles and a drain tile supported by the upper surface.

18. The assembly of claim 13, further comprising a bondable interface attached to an underside of the frame, the bondable interface providing an improved bonding interface between the frame and underlying support structure.

19. The assembly of claim 13, wherein the one or more of the plurality of vertical spacers are encompassed by the adhesive extending between the one or more attached surface tiles and the frame.

* * * * *